US010745038B2

(12) United States Patent
Gao et al.

(10) Patent No.: US 10,745,038 B2
(45) Date of Patent: Aug. 18, 2020

(54) ROUTE RESOURCE CONTROLLING METHOD, INTELLIGENT VEHICLE ON-BOARD CONTROLLER AND OBJECT CONTROLLER

(71) Applicant: Traffic Control Technology Co., Ltd, Beijing (CN)

(72) Inventors: Chunhai Gao, Beijing (CN); Qiang Zhang, Beijing (CN); Junguo Sun, Beijing (CN)

(73) Assignee: Traffic Control Technology Co., Ltd, Beijing (CN)

( * ) Notice: Subject to any disclaimer, the term of this patent is extended or adjusted under 35 U.S.C. 154(b) by 404 days.

(21) Appl. No.: 15/823,364

(22) Filed: Nov. 27, 2017

(65) Prior Publication Data

US 2019/0144023 A1 May 16, 2019

(30) Foreign Application Priority Data

Nov. 14, 2017 (CN) ..... 2017 1 1120782

(51) Int. Cl.
*B61L 27/00* (2006.01)
*B61B 1/00* (2006.01)
(Continued)

(52) U.S. Cl.
CPC ..... *B61L 27/0016* (2013.01); *B61B 1/00* (2013.01); *B61L 3/006* (2013.01); *B61L 3/008* (2013.01); *B61L 23/08* (2013.01); *B61L 23/18* (2013.01); *B61L 27/0027* (2013.01); *B61L 27/0038* (2013.01); *G08G 1/096741* (2013.01);
(Continued)

(58) Field of Classification Search
None
See application file for complete search history.

(56) References Cited

U.S. PATENT DOCUMENTS 5,533,695 A * 7/1996 Heggestad ..... B61L 3/125 246/1 R
5,828,979 A * 10/1998 Polivka ..... B61L 27/0016 701/117

(Continued)

FOREIGN PATENT DOCUMENTS

EP 1695890A1 A1 8/2006
WO WO2016022635A1 A1 2/2016

OTHER PUBLICATIONS

The Extended European Search Report for European Application No. 17203621.2, dated Sep. 18, 2018, 14 pages.

(Continued)

*Primary Examiner* — Truc M Do
(74) *Attorney, Agent, or Firm* — Law Offices of Liaoteng Wang

(57) ABSTRACT

An embodiment of the present disclosure provides a route resource controlling method, intelligent vehicle on-board controller and object controller. The method comprises: determining a route search extension distance of a train based on current location and speed of the train, wherein the current route search extension distance is the farthest distance in front of the train that is currently expected to be safe for operation based on current speed of the train; determining the currently required link and route resource contained thereof; determining the target authority of the route resource.

16 Claims, 3 Drawing Sheets

(51) Int. Cl.

| | |
|---|---|
| ***G08G 1/0967*** | (2006.01) |
| ***B61L 23/08*** | (2006.01) |
| ***B61L 3/00*** | (2006.01) |
| ***B61L 23/18*** | (2006.01) |
| *B61L 27/04* | (2006.01) |

(52) U.S. Cl.
CPC ..... *G08G 1/096775* (2013.01); *B61L 27/04* (2013.01); *B61L 2027/005* (2013.01)

(56) References Cited

U.S. PATENT DOCUMENTS 6,135,396 A * 10/2000 Whitfield ..... B61L 3/125 246/167 R
6,246,956 B1 * 6/2001 Miyoshi ..... B61L 23/16 246/182 R
8,924,049 B2 * 12/2014 Kumar ..... B61L 27/0027 701/19
9,156,477 B2 * 10/2015 Cooper ..... B61L 3/006
9,733,625 B2 * 8/2017 Kumar ..... B61L 3/006
2002/0027495 A1 * 3/2002 Darby, Jr. ..... B61L 3/125 340/298
2004/0172174 A1 * 9/2004 Julich ..... B61L 27/0016 701/19
2008/0315044 A1 * 12/2008 Stull ..... B61L 27/0005 246/5
2009/0187291 A1 * 7/2009 Daum ..... B61L 3/006 701/2
2009/0230254 A1 * 9/2009 Daum ..... B61L 3/125 246/27
2010/0023190 A1 * 1/2010 Kumar ..... B61L 3/006 701/20
2013/0218375 A1 * 8/2013 Ning ..... B61L 23/14 701/19
2014/0103166 A1 * 4/2014 Asuka ..... B61L 23/24 246/4
2014/0300739 A1 10/2014 Mimar
2015/0102177 A1 * 4/2015 Tippey ..... B61L 15/0027 246/122 R
2016/0200327 A1 * 7/2016 Liu ..... B61D 17/00 105/8.1

OTHER PUBLICATIONS

The first Office Action for European Application No. 17203621.2, dated Feb. 25, 2019, 10 pages.

* cited by examiner

ROUTE RESOURCE CONTROLLING METHOD, INTELLIGENT VEHICLE ON-BOARD CONTROLLER AND OBJECT CONTROLLER

CROSS-REFERENCE TO RELATED APPLICATION

This application is based upon and claims priority to Chinese Patent Application No. 201711120782.2, filed on Nov. 14, 2017, which is incorporated herein by reference in its entirety.

FIELD

The present disclosure relates to the field of train operation control, and more particularly, to a route resource controlling method, intelligent vehicle on-board controller and object controller.

BACKGROUND

With its comfortable, low-carbon, efficient and safe advantages, urban rail transit occupies an increasing proportion in people's daily travel public transport. Currently, the urban rail transit operation control technology is based on a mobile jamming signal control system technology of communication based train control system (CBTC).

Traditional CBTC communicates path information to a computer interlocking (CI) through an Automatic Train Supervision (ATS) system. A zone controller (ZC) communicates the path information to the computer interlocking (CI). Admission passages are performed by the CI using antagonism of path designs, sections of admission passages are spliced together for a whole operation schedule. The ZC calculates movement authorization (MA) for a train based on admission passages of the CI and locations of the train, it ensures that Mas of two trains do not overlap each other by antagonism of admission passages so as to avoid collision. However, admission passages in system are usually set in advance, it may only reach a number of parking spots, if a train is commanded to reach an unplanned location, t manual operation CI is needed: moving a switch to the specified location, adjusting annunciator and other device to schedule the train. Path planning and route resource control is not flexible enough to affect the efficiency of train operation.

With vigorous development of rail transit, the operational capacity of rail transit is increasing, and frequency of use of signal system device increases. Under the premise of ensuring safety of driving and high reliability of the equipment, it is the direction of the future development of the signal system to reduce the railside equipment, station equipment and the shortening train running interval. Based on vehicle-vehicle communication, an IVOC (intelligent vehicle controller On-board)-concentrated mobile occlusion system emerges in response. A train in the system uses the vehicle-vehicle communication and vehicle-ground communication to calculate mobile authorization autonomously, it replaces CI and ZC in traditional system with an object controller (OC), which serves as a route resource manager. It is an important issue to be solved to realize allocation of the route resources and safety control in the multi-train operation, without affecting the efficiency and safety of the train operation. Efficient usage of route resource is a problem for existing IVOC-concentrated mobile occlusion system.

SUMMARY

An embodiment of the present disclosure provides a route resource controlling method, intelligent vehicle on-board controller and object controller. It realizes flexible configuration of the traffic lane resources, improves the resource utilization rate and ensuring the operation safety and efficiency of the train.

According to an aspect of the present disclosure, a route resource controlling method is provided, the method comprises: determining a route search extension distance of a train based on current location and speed of the train, wherein the current route search extension distance is the farthest distance in front of the train that is currently expected to be safe for operation based on current speed of the train; determining the currently required link and route resource contained thereof according to current location of the train and the current route search extension distance; determining the target authority of the route resource, the target authority is either exclusive lock authority or shared lock authority; sending a route resource occupation request according to the target authority to an OC, and receiving a resource application result for the route resource occupation request returned by the OC; and determining the current safe path for the train based on the route search extension distance and the resource application result.

According to another aspect of the present disclosure, a route resource controlling method is provided, the method comprises: receiving a route resource occupation request sent by the ITS system or IVOC, wherein the route resource occupation request comprises the requested route resource and the target resource thereof, wherein the target authority is exclusive lock authority or shared lock authority; determining resource application result of the route resource occupation request based on the route resource occupation request and current state of the requested resource; and sending the resource application result to the ITS system or IVOC. The IVOC may determine the current safe path of the train based on the current route search extension distance and resource application result of the train; or the ITS system may determine the current safe path for the corresponding train based on the current route search extension distance and resource application result of the train that would be under control of the ITS system, wherein the current resource occupation state are exclusive lock state, shared lock state and release state.

According to yet another aspect of the present disclosure, the route resource controlling method may further comprise: receiving a route resource release instruction issued by the IVOC or ITS system, the route resource release instruction comprises the route resource to be released and the target authority thereof; and releasing the target authority for the corresponding route resource according to the route resource release instruction.

According to yet another aspect of the present disclosure, an intelligent vehicle on-board controller (IVOC) is provided, the IVOC comprises: a route search determination module, for determining a route search extension distance of a train based on current location and speed of the train, wherein the current route search extension distance is the farthest distance in front of the train that is currently expected to be safe for operation based on current speed of the train; a route resource determination module, for determining the currently required link and route resource contained thereof according to current location of the train and the current route search extension distance; a resource authority determination module, for determining the target authority of the route resource, the target authority is either exclusive lock authority or shared lock authority; and a resource occupation application module, for sending a route resource occupation request according to the target authority to an OC, and receiving a resource application result for the route resource occupation request returned by the OC.

According to yet another aspect of the present disclosure, an object controller (OC) is provided, the OC comprises: a resource occupation request receiving module, for receiving a route resource occupation request sent by the ITS system or IVOC, wherein the route resource occupation request comprises the requested route resource and the target resource thereof, wherein the target authority is exclusive lock authority or shared lock authority; and a resource control module, for determining resource application result of the route resource occupation request based on the route resource occupation request and current state of the requested resource; and sending the resource application result to the ITS system or IVOC. The IVOC may determine the current safe path of the train based on the current route search extension distance and resource application result of the train; or the ITS system may determine the current safe path for the corresponding train based on the current route search extension distance and resource application result of the train that would be under control of the ITS system, wherein the current resource occupation state are exclusive lock state, shared lock state and release state.

According to the route resource controlling method, intelligent vehicle on-board controller and object controller of an embodiment of the present disclosure, in multiple-trains situation, trains with same operation schedule may apply shared lock authority of route resource, realizing intra-train short distance operation under monitoring. In multiple-trains situation of hostile or conflict, mutual exclusion of safe paths are prevented by exclusive lock authority (i.e., mutual exclusion authority) of route resources. Furthermore, vehicle-vehicle communication realizes protection between locations of trains and the MAs, so as to ensure safe and efficient operation of trains.

BRIEF DESCRIPTION OF THE DRAWINGS

Other features, objects, and advantages of the present disclosure will become more apparent from a reading of the following detailed description of a non-limiting example with reference to the accompanying drawings in which like or similar reference numerals refer to like or similar features.

DETAILED DESCRIPTION

Figure 1:
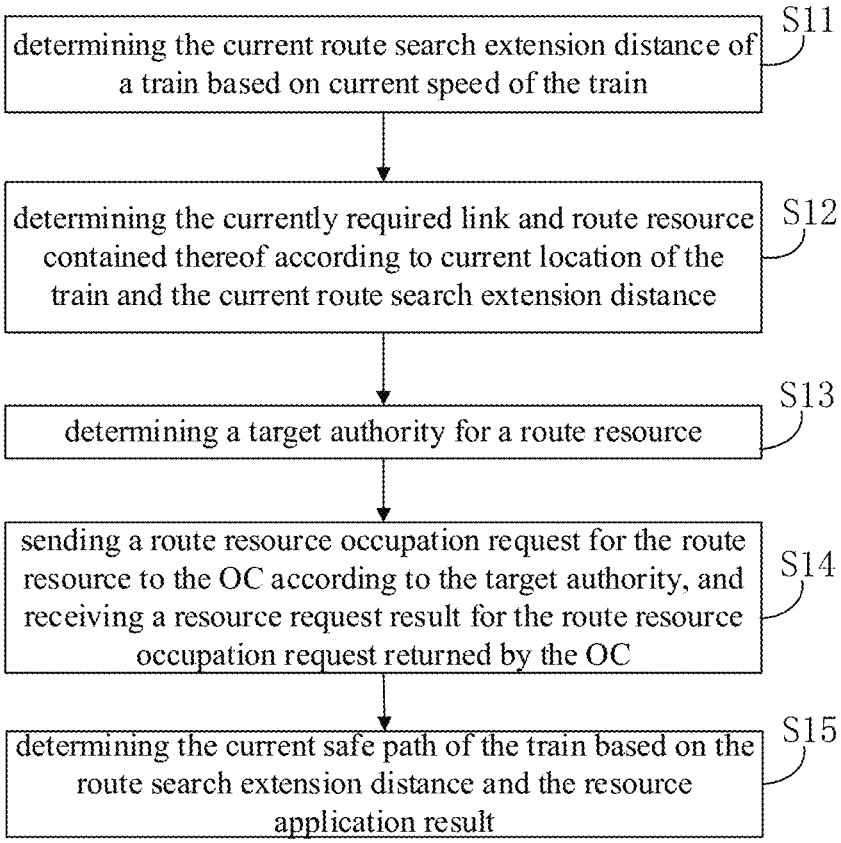
FIG. 1 is a flow diagram of a route resource controlling method in an embodiment of the present disclosure.

Features and exemplary embodiments of various aspects of the present disclosure will be described in detail below. In the following detailed description, numerous specific details are set forth in order to provide a thorough understanding of the present disclosure. It will be apparent, however, to a person skilled in the art that the present disclosure may be practiced without the need for some of the details in these specific details. The following description of the embodiments is merely for the purpose of providing a better understanding of the present disclosure by showing examples of the present disclosure. The present disclosure is by no means limited to any of the specific configurations and algorithms set forth below, but is intended to cover any modifications, substitutions, and improvements of elements, components and algorithms, without departing from spirit of the invention. In the drawings and the following description, well-known structures and techniques are not shown, in order to avoid unnecessarily obscuring the present disclosure.

FIG. 1 shows a flow chart of a controlling method of a route resource provided by an embodiment of the present disclosure. As shown in the figure, the controlling method of the route resource in an embodiment of the present disclosure may include the following steps.

Step S11: determining the current route search extension distance of a train based on current speed of the train.

Step S12: determining the currently required link and route resource contained thereof according to current location of the train and the current route search extension distance.

In an embodiment of the present disclosure, the train running path is described by link. Wherein between any axis and turnout, or between the axis and the measured axis, or between the turnout and turnout, or a certain length of the line it may be divided into a link (also called a line section), by this link partitioning method, any point on the running path may be described by link+offset, the offset is the distance between a point within the link and the starting point of the link. The route search extension distance has a positive correlation with current speed of the train, it enables to improve speed of a train as much as possible base on the premise of safe operation of the train.

During operation of a train, route search will be performed by an IVOC of the train based on current location and speed of the train to determine route search extension distance of the train. Currently required link sequence (i.e., link sequence contained in the route search extension distance) is then determined based on current location and the determined route search extension distance of the train. Wherein the current route search extension distance is the farthest distance in front of the train that is currently expected to be safe for operation based on current speed of the train; that is the farthest distance that the train is currently expected to be safe to run. The extension distance is the distance between the current location of the train and the farthest safe distance in the front.

The currently required link sequence above comprises all path segment in the determined route search extension distance. After the currently required link sequence of the train is determined, corresponding route resource may be applied to the object controller (OC) according to the route resource contained in the currently required link sequence. Wherein the route resources include but not limited to sections, turnouts, crossed lines, and other railside equipment. The route resources included in each link on the running path are fixed. Route resource information corresponding to all links along the path may be stored in the ITS system and/or OC and/or running path electronic map. The IVOC may obtain route resources contained in the currently required link sequence either by searching route resource contained in the currently required link sequence via the path electronic map, or by communicating with the TIS system or communicating with the OC.

In an embodiment of the present disclosure, before the train applies for the route resources from the OC, the route search extension distance is determined firstly. Therefore operation efficiency and safety of the train are not affected, and waste of route resource resulted from overabundance of applies for the route resources is avoided at the mean time.

The route search extension distance is generally positively related to the current speed of the train, the higher the speed is, the farther the route search extension distance would be. In practice, different determination process of route search extension distances may be selected according to the actual needs. For example, an extended distance calculation rule that is positively correlated with the train running speed may be set in advance, and the calculation is performed according to the current speed and the extension distance calculation rule of the train when determining the path extension distance.

In an embodiment of the disclosure, it is preferable to determine the current route search extension distance of the train based on the current speed of the train, comprising:

$$L_{route\ search}=\max\{L_{dynamic}, L_{min}\}$$

wherein $L_{route}$ search represents the current route search extension distance; $L_{dynamic}$ represents the dynamic extension distance of the route search determined according to the current speed of the train, and $L_{dynamic}$ is proportional to the current speed of the train; and $L_{min}$ represents the default minimum extension distance. That is, the current route search extension distance is the larger value of the dynamic extension distance and the minimum extension distance.

In actual operation, in case that the current speed of the train is greater than a certain speed, $L_{route}$ search general takes the value of $L_{dynanmic}$, the greater the speed, the farther the route search extension distance would be. In case that the current speed of the train is low, $L_{route}$ search general takes the value of $L_{min}$, so that even if the train is running at low speed, the route search extension distance may be maintained to a certain length to ensure that the train may take up the required resources at low speed. The method is more suitable for actual train running scenario by satisfying the trajectory exploration requirements of the train in two different running scenarios of high speed and low speed.

In an embodiment of the present disclosure, $L_{dynamic}$ may be calculated as follows:

$$L_{dynamic}=K_1\times V_{current}^2+K_2\times V_{current}$$

wherein $V_{current}$ is the current speed of the train, $K_1$ is a first preset coefficient, $K_2$ is the second preset coefficient, wherein $K_1$ and $K_2$ are positive numbers.

In an embodiment of the present disclosure, $K_1$ may be inversely proportional to the maximum braking rate of the train. Under this circumstance, $K_1\times V_{current}$ represents train's expected braking distance.

In an embodiment of the present disclosure, $K_2$ may be determined according to the following items: the time needed for the train to switch from the current state desired state according to the preset route resource, the preset time for interacting with the OC when requesting route resource from the OC, and the preset time for the OC to processing train route resource request. $K_2\times V_{current}$ represents the expected travel distance of the train in the process of applying for the specified route resource and controlling the specified resources.

In a specific embodiment of the disclosure, $$K_1=\frac{1}{2\times a_{barke}},$$

where $a_{brake}$ represents the maximum braking rate of the train.

In a specific embodiment of the present disclosure, $K_2=t_{resources\ drive}+t_{information\ interaction}+t_{information\ processing}$.

Wherein the $t_{resource\ drive}$ the time at which the route resource is switched from the current state to the desired state of the train (i.e., the estimated time for resource-drive, e.g., the time required for a turnout to switch to desired location for the train), and $t_{information\ interaction}$ represents the time for the train to interact with the OC when applying route resources from the OC, $t_{information\ processing}$ represents the time that the OC processes the route resource occupation request of the train (i.e., the time for the train to process information).

In a method according to an embodiment of the present disclosure, prior to determining the current required link sequence of the train and the route resource contained in the currently required link sequence, based on the current location of the train and the current route search extension distance, the method further comprises:

Obtaining an operation schedule of a train; determining an entire line link sequence and route resources requested by the entire line based on the operation schedule, wherein the route resources requested by the entire line comprises route resources contained in the currently required link sequence.

In an embodiment of the present disclosure, the operation schedule of the train comprises the man-machine interface (MMI) arbitrary parking area operation schedule, wherein the MMI arbitrary parking area operation schedule is the operation schedule of the running path determined by the train itself based on the arbitrary position of the driver input obtained by the MMI module.

Based on the MMI arbitrary parking area operation schedule, the train driver may determine the operation schedule of the train on his/her own. The train driver may control the train to run on the path with any position as the destination, so that the train operation mode is more flexible and may better meet the actual operational requirements. The above MMI module is a human-computer interaction module mounted on the train, for obtaining the driver's operation instruction, including the destination information input by the driver.

Definitely, in actual operation the train operation schedule may also be an operation schedule issued by an Intelligent Train Supervision (ITS) system and received by the IVOC. Wherein the operation schedule issued by the ITS system may be an ITS line schedule or ITS any-location schedule. ITS line schedule refers to a train operation with the turnback parking area specified by the ITS system as the destination (running to the end of a path for parking following the path specified by the ITS system). ITS any-location schedule refers to train operation with any location on the path specified by the ITS system as the destination following a running path determined by the train itself.

The ITS system serves as a control center of train control system, it provides train operation dispatchers with a monitoring platform for entire range of traffic, vehicles, electrical and mechanical equipment and power supply equipment, and processes emergency treatment under emergence. By communicating with the OCOC and IVOC of the train, the ITS system obtains real-time state information for train operations and spot equipment signal, and displays such information to train operation dispatchers; the train operation dispatchers issue control commands based on spot conditions.

Figure 2:
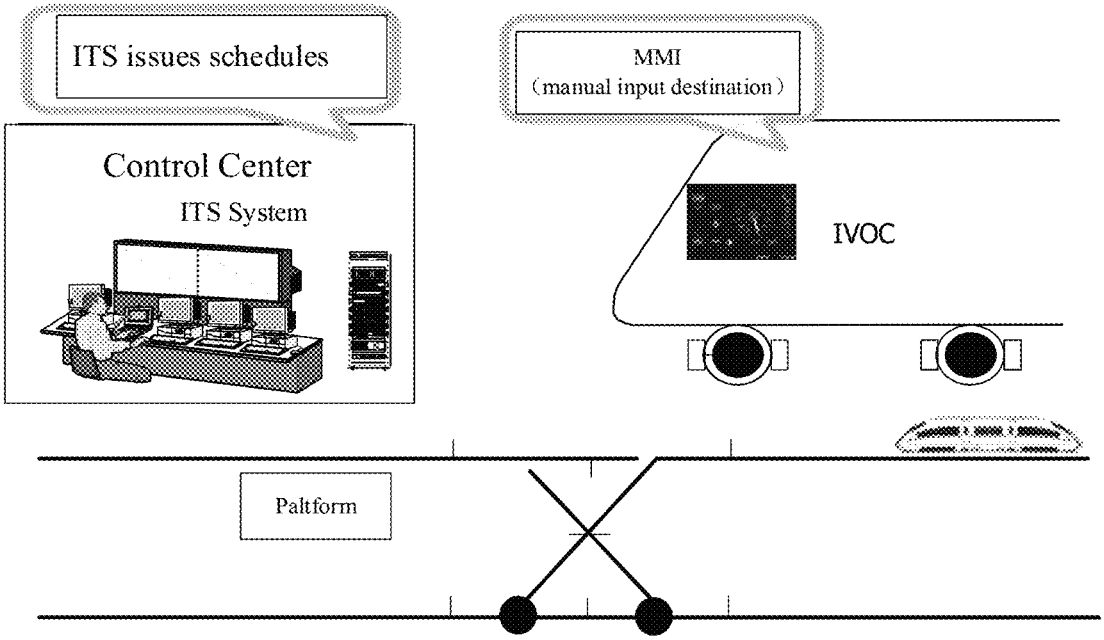
FIG. 2 is a schematic diagram of a train operation schedule obtaining in an embodiment of the present disclosure.

As may be seen, in an embodiment of the present disclosure, in a vehicle-vehicle communication-based train control system, the IVOC acquisition operation schedule may have two forms: a destination inputted by an MMI module and operation schedule issued by the ITS system, as shown in FIG. 2. There are three types of operation schedules: ITS lien schedule, ITS any-location schedule, and MMI any parking area operation schedule. The IVOC may perform parse according to any of the three types of schedules described above to obtain the entire line link sequence and the route resources required for the entire line. Through flexible use of the three operation schedules, planning of any location on the path may be performed, and scheduling and operation would be more flexible compared with traditional signal systems.

Specifically, for the ITS line schedule, the train selects a running path and inquires for corresponding link sequence for a specified destination based on scheduled (by the ITS system) line turn-back parking area; that is the train runs with the destination of line turn-back parking area specified by the ITS system. For any ITS any-location schedule, the schedule contains any location on the path inputted by the ITS system. The IVOC may intelligently select the path according to this location and query corresponding link sequence to make the train reach specified location, that is, any location on the path specified by the ITS system is the destination for self-determined train operation. MIMI arbitrary parking area schedule takes any location on the line of the inputted by the driver as the destination, intelligently selects the path according to this location and determines authority link sequence of the corresponding link sequence, so as to make the train reach specified location.

Step S13: determining a target authority for a route resource.

Step S14: sending a route resource occupation request for the route resource to the OC according to the target authority, and receiving a resource request result for the route resource occupation request returned by the OC.

In an embodiment of the present disclosure, the route resource include authority exclusive lock authority and shared lock authority. The exclusive lock authority refers to the right that only one train may use and control the route resource. The shared lock authority refers to the right that the route resource may be used more than one train. Corresponding to the route resource authority, occupation state of route resource may include an exclusive lock state (referred to as exclusive state), a shared lock state (referred to as shared state), and a release state. Wherein the exclusive state means that the route resource is applied by one train for exclusive lock authority successfully; the shared state means that the route resource is applied by at least one train for shared lock authority successfully; and the release state means that the route resource is not applied by any train. That is, if the OC allocates exclusive lock authority of the route resource for a train, the state of the route resource is exclusive and cannot be allocated to other trains. The OC may allocate shared lock authority for the path rescore to a train, while other trains still able to apply for a shared lock authority for the path rescore, with a train applies for the shared lock cannot control a route resource. If a request cannot be sent to the OC, then switch a turnout to a reverse position.

In an embodiment of the present disclosure, control and allocation of the route resources is realized by the OC. After determining the route resource contained in the currently required link sequence, the IVOC needs to determine the target authority of the route resource contained in the currently required link sequence according to operation requirements, so as to send a route resource occupation request to the OC to which the applied route resource corresponds according to the target authority of the route resource. Target authority refers to control permission of the route resource that is currently required by the train, the control permission pertains to one of the above exclusive lock authority and shared lock authority.

During operation of a train, after establishing communication with the OC of corresponding management range, an IVOC of the train needs to perform safe path (safe-path, the path that guarantees vehicles from collision) registration. The registration of the safe route resource refers to a "route establishment" process performed by the IVOC based on the route search extension distance and actual path conditions for a train; the result of "route establishment" may be extended to end or intermediate point of the route search extension distance according to the actual situation. The so-called "route establishment" refers to the application of route resources, including the turnout resource registration, the infringing section registration, the protection section of registration. An established SAFE-PATH comprises a complete set of link or link offset values, and turnout state in SAFE-PATH. The completion of the SAFE-Route resource means that the route resources (turnouts, lines, protection zones) on the path to be registered have been successfully applied, and then the train may focus on only other trains, emergency stop button (EMP), station safety doors (PSD) and other state variable information. The SAFE-Route resource registration is carried out every cycle. Depending on whether the current state of the route resource is the same as the expected state (desired state), it is also necessary to control the route resource, such as whether it is necessary to switch the turnover.

As can be seen, after determining the extension distance of the current route search, it is necessary for a train to apply target authority of the currently required link sequence to OC according to the currently required link sequence included in the route search extension distance. Only the path consisted of links corresponding to route resource with successful target authority may serve as the current SAFE-PATH of the train.

In an embodiment of the present disclosure, the train performs the above-mentioned secure route resource registration by sending a route resource occupation request to the OC, and determines whether the train would apply successfully based on the current resource occupation state of the route resource requested in the route resource occupation request and occupation request of the train, and send the results of the resource application to the IVOC of the corresponding train.

After the IVOC of the train sends a route resource occupation request to the OC, the OC determines whether the target resource of the corresponding route resource may be allocated with the target authority to the train according to the current resource occupation state of the train. Different trains race for resource occupation according to the OC route resource allocation result. The OC allocates the route resource to the train, and applies corresponding resource lock for respective route resource according to the allocated authority, and realizes the state management of the route resource.

Figure 3:
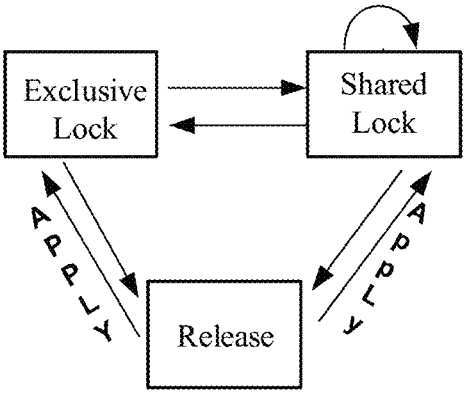
FIG. 3 is a schematic diagram of a resource lock state switch for route resources in an embodiment of the present disclosure.

The resource lock above is a way in which the OC performs state management for route resource, it is divided into exclusive lock and shared lock, which corresponds to the exclusive lock state and the shared lock state of the route resource respectively. As shown in FIG. 3, release means that the state of the route resource being the release state. After the OC allocated a train with a route resource exclusive lock authority, then the corresponding route resources is set with exclusive lock. After the OC allocated a train with a shared lock authority, then the corresponding route resources is set with shared lock. When the route resource is in the release state, the train may be allocated with exclusive lock authority or shared lock authority according to the target authority in the IVOC route resource occupation request.

In an embodiment of the present disclosure, the route resource comprises a turnout, and the turnout resource is taken as an example, determining the target authority of the route resource comprises: determining the desired state of the turnout, wherein the turnout state comprises positioning and inversion; obtaining the current state of the turnout; and determining the target authority of the turnout according to the desired state of the turnout and the current state of the turnout.

In an embodiment of the present disclosure, determining the target authority of the turnout according to the desired state of the turnout and the current state of the turnout comprises: in case that the desired state of the turnout and the current state of the turnout are different, determining the target authority of the turnout as exclusive lock authority; in case that the desired state of the turnout is the same as the current state of the turnout and the train running mode is forward, determining the target authority of the turnout as shared lock authority; and in case that the desired state of the turnout is the same as the current state of the turnout and the train running mode is reentrant, determining the target authority of the turnout as exclusive lock authority.

In an embodiment of the present disclosure, the turnout is used as a route resource, and the control and passage of the turnout needs to be realized by applying the resource lock. An exclusive lock of a train application for a turnout means that other trains cannot use the turnout before the train releases the turnout resource. The trailer's shared lock means that other trains are allowed to use the turnout at the same time, provided that the other trains and the trains use the same turnout position (positioning/reverse), where the frequently-used position of the turnout is the positioning position, and the less-used location is the reverse position.

In case that there is a turnout in the path to which the current link sequence corresponds, the IVOC determines the required turnout state is positioning or reverse position according to the train's traffic schedule, and then communicates with the OC to learn the current state of the turn, and determines the target authority of the turnout according to the required state and the current state. Specifically, the IVOC determines whether to apply for exclusive lock or shared lock depending on the desired state of the turnout, the current state, and the mode of operation of the train (rewind/pass).

In an embodiment of the present disclosure, when the current state of the turn is coincident with the expected state (desired state), the shared lock is requested, and if the current state of the turnout does not coincide with the expected state, the turnout state change is required to reach the desired state, then an exclusive lock is needed to be applied. In order to prevent the follow-up train from trailing into the reentry area during the reentry of the train, the train will be rejoined. The train for reentry will release a turnout exclusive lock authority after passing through the turnout and leaving the reentry area.

In an embodiment of the present disclosure, if the desired state of the turnout is different from the current state, the route resource occupation request sent by the IVOC to the OC (corresponding to the turnout resource occupation request) also comprises the corresponding turnout (i.e., the desired state and the current state different turnout), wherein the switching instruction is used to switch the turnout from the current state to the desired state under control of the OC when the exclusive lock authority application of the corresponding turnout is successful.

In a method of an embodiment of the present disclosure, after the corresponding turnout controlled by the OC is switched from the current state of the turnout to the desired state of the turnout, and further comprises: sending an authority conversion request for the corresponding turnout to the OC, and the authority conversion request is used to request that the target authority of the corresponding turnout is switched from the exclusive lock authority to the shared lock authority.

During train operation, authority request of the route resource may be sent to the OC according to the traffic demand and the state of the route resource, so that the state of the route resource may be switched in real time to realize the flexible configuration of the route resource. As shown in FIG. 3, in an embodiment of the present disclosure, the three-state jump conditions of the turnout resource are as follows:

A) the turnout is currently in shared state, then other trains may apply shared lock authority for the same location.

B) the turnout is currently in exclusive state, then the other train does not allowed to apply for exclusive lock authority or shared lock authority.

C) upon finishing turnout determination by the current exclusive train (i.e., switching from the current state to the desired state), the turnout resource may be changed from exclusive lock state to shared lock state.

D) upon finishing turnout determination by the train sharing current turnout that there is no other trains sharing the turnout, the turnout resource may be applied to be switched from shared state to exclusive state.

E) upon issuing a releasing command by the train with exclusive authority of current turnout to the OC, the OC clears exclusive lock authority for the turnout to make it switch from exclusive state to shared state.

F) upon issuing a releasing command by the train sharing current turnout to the OC, the OC clears shared lock authority for the turnout, if there is other train(s) enjoys the shared authority, the turnout is still in a shared lock state until all shared locks on the turnout are released, then the turnout is no longer in the shared lock state and is released.

As can be seen, turnout authority may vary from exclusive lock authority to shared authority for a train without affecting safe operation of the train. Other route resources on the line may be allocated in accordance with the concept of turnout control by the following operations: applying, by the train for corresponding route resources and corresponding resource target authority from an OC, and setting, by the OC the resource lock for flexible allocation of route resources.

Step S15: determining the current safe path of the train based on the route search extension distance and the resource application result.

Upon receiving the resource application result returned by the OC, the train may determine the current safe path according to the current path extension distance and the resource application result. Only when the train has access to the corresponding route resources (i.e., the target authority that the application is successful) can it pass resource (e.g., turnout, screen door and other route resources) in the path correctly, so as to achieve the train path security protection.

In an embodiment of the present disclosure, if the IVOC receives successful result of the resource request for the route resource occupation request returned by the OC (i.e., the target authority application is successful and the state of the route resource is in the desired state), then the safe path of the train may be extended to corresponding path of the route resource, otherwise the safe path may only be extend to the proximal end (with respect to the train) of the corresponding link of the corresponding route resource. For example, if the target authority application for a turnout is successful and the turnout is in the desired state, the safe path of the train may be extended to the end of the turnout section, otherwise the safe path may only be extend to the starting point (defined in the electronic map)) of the turnout section.

During the operation of the train, the IVOC will determine the current safe path of the train by selecting links in the currently required link sequence according to the result of the route resource application feedback from the OC cycle and extending the safe path.

In a method an embodiment of the present disclosure, after determining the current safe path of the train based on the route search extension distance and the resource application result, the method may further comprises: calculating the current mobile authorization (MA) of the train based on the current safe path; and controlling train operation according to the current MA.

After the current safe path is determined by the IVOC of the train, according to the train's current operating information, the current speed limit information, parking and other relevant information on the basis of this safe path, the current MA of the train is calculated to achieve independent operation of the train. In addition, in order to protect the safety of traffic, for the safe path within the turnout, if the turnout is in action, even if the train has exclusive lock authority, the train still should not to switch the turnover. In other words, the train with the exclusive lock authority in the OC to send a turnout after the instruction, in accordance with the instructions to control the switch in the process of switching, the OC no longer perform switching command issued by the train or the ITS system.

In a method according to an embodiment of the present disclosure, when the train is operated according to the current MA, the method further comprises: after the train has passed the route resources in the current MA, sending the resource release instruction of the available route resources to the OC so that the OC releases the target authority of the corresponding route resource requested by the train according to the resource release instruction, wherein the route resource release instruction comprises the route resources to be released and the target authority of the route resources to be released.

The IVOC sends the resource release instruction of the corresponding route resource to the OC so that the OC releases the corresponding route resource according to the resource release instruction after the train has passed the route resource. Route resource release means the target authority for route resource applied by the train cancelling resource release instruction previously. Through the application of route resources and resource release, the states of route resources are enabled to be switched in real time, so as to achieve flexible allocation of route resources.

In a method according to an embodiment of the present disclosure, the train is operated according to the current MA, the method further comprises: receiving the information that the target authority for route resource in the current safe path is cancelled sent by the OC; re-determining the current safe path, wherein the end of the re-determined current safe path does not exceed the proximal end of the corresponding route resource; re-calculating the current MA for the train based on the re-determined safe path; and controlling operation of the train based on the re-calculated current MA.

When the IVOC of the train operates according to the current MA control train, if the IVOC communicates with the OC to learn that the target authority of the route resource within the current safe path range are canceled (including that the authority is canceled or the route resource is not in desired state), then the safe path needs to be cancelled immediately. A new current safe path needs to be re-determined and a new current MA needs to be calculated to ensure the safe operation of the train. The IVOC may re-apply the corresponding route resource and target authority to the OC according to the need, and then re-determine the new current safe path according to the application result after the target authority of the received route resource is canceled.

The controlling method of the route resource of an embodiment of the present disclosure completely changes the concept of the train approach in the traditional CBTC rail transit signal control system, and achieves the free competition of the train to the route resource in the new generation of train control system based on the vehicle communication. The OC plays the role of route resource manager to achieve the flexible allocation of route resources and efficient use of the train to achieve a moving state of the shorter tracking interval. Compared with traditional approach, the resource competition provides a more refined route resources control process, it realizes train resource in a section from starting point of the current location and the end point of the route search, it enables real-time application and release as well as reduces waste of route resources.

Figure 4:
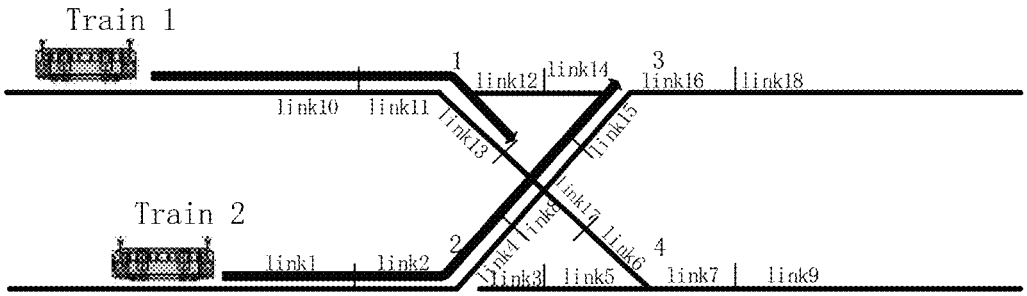
FIG. 4 is a schematic representation of a scene of a different train competing for a turnout resource in an embodiment of the present disclosure.

In an application scenario as shown in FIG. 4, the train 2 applies shared lock authority of the turnout 2, the crossing line and the turnout from the OC, and may normally pass through the current safe path of the train via the crossing zone. While the train 1 only successfully applied shared lock authority of the turnout 1 of the, so that safe path the train 1 may only be extended to link 13.

Figure 5:
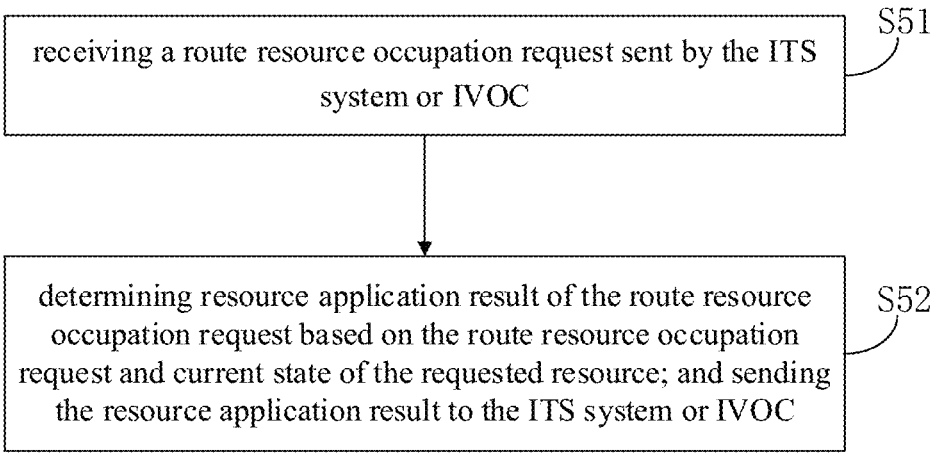
FIG. 5 is a flow diagram of a route resource controlling method in another embodiment of the present disclosure.
Figure 6:
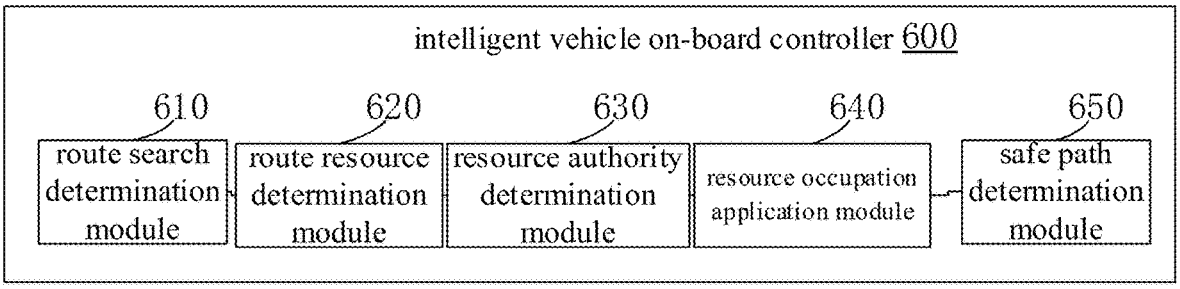
FIG. 6 is a schematic diagram of an intelligent vehicle on-board controller in an embodiment of the present disclosure.

FIG. 5 shows a controlling method of a route resource provided in another embodiment of the present disclosure. As shown in FIG. 5, a route resource controlling method of the according to an embodiment of the present disclosure may include the following steps:

Step S51: receiving a route resource occupation request sent by the ITS system or IVOC.

Step S52: determining resource application result of the route resource occupation request based on the route resource occupation request and current state of the requested resource; and sending the resource application result to the ITS system or IVOC.

The controlling method of the route resource shown in FIG. 5 is described with respect to the OC side. The OC serves as a route resource control and management device responsible for allocation of route resources and control, so as to achieve the safe use of route resources for the train.

In an embodiment of the present disclosure, the OC communicatively coupled with the IVOC and the ITS system respectively to receive the route resource occupation request of the IVOC or ITS system, wherein the route resource occupation request comprises the requested route resource and the target resource thereof, wherein the target authority is exclusive lock authority or shared lock authority. After receiving the route resource occupation request of the IVOC or ITS system, the OC may determine resource application result of the route resource occupation request based on the route resource occupation request and current state of the requested resource; and send the resource application result to the ITS system or IVOC. The IVOC may determine the current safe path of the train based on the current route search extension distance and resource application result of the train; or the ITS system may determine the current safe path for the corresponding train based on the current route search extension distance and resource application result of the train that would be under control of the ITS system.

As can be seen, in a route resource controlling method of an embodiment of the present disclosure, the route resource occupation request may be sent from the IVOC of a train to the OC, or may be sent from the ITS system to the OC. As mentioned above, the IVOC of the train obtains the target authority of the corresponding route resource by sending the resource occupation request to the OC, so as to realize the safe operation of the train. The ITS system may send the route resource occupation request to the OC according to the running demand of the whole line. For example, if the ITS system needs to control a train to run to the designated position, the ITS system may send the corresponding route resource line to the OC according to the running path of the train resource occupation request.

In an embodiment of the present disclosure, the route resource controlling method may further comprise: receiving a route resource release instruction issued by the IVOC or ITS system, the route resource release instruction comprises the route resource to be released and the target authority thereof; and releasing the target authority for the corresponding route resource according to the route resource release instruction.

Upon receiving the route resource release instruction issued by the IVOC or ITS system, the OC releases the target authority of the route resource requested by the IVOC or ITS system.

It should be noted that in practice, a train's IVOC or ITS system may send route resources to the OC release resource instructions, releasing the route resources target authority that has been successfully applied by the train or the ITS system. The ITS system is the control center of the entire train control system and may be manually intervened to release the target authority of the route resources requested by the train, but the train cannot release the target authority of the ITS system or other resource applications for trains. Under normal circumstances, a train should release route resources (such as turnout) exclusive lock or shared lock to the OC initiatively after it exits the turnout section. In order to ensure safety of operation, in case of train reentry, the time to release turnout resource is when a train exits reentry area and the turnout section.

According to a route resources controlling method according to an embodiment of the present disclosure, in multiple-trains situation, trains with same operation schedule may apply shared lock authority of route resource, realizing intra-train short distance operation under monitoring. In multiple-trains situation of hostile or conflict, mutual exclusion of safe paths are prevented by exclusive lock authority (i.e., mutual exclusion authority) of route resources. Furthermore, vehicle-vehicle communication realizes protection between locations of trains and the Mas, so as to ensure safe and efficient operation of trains.

Corresponding to the route resource controlling method as shown in FIG. 1, an intelligent vehicle on-board controller (IVOC) 600 is further provided in an embodiment of the present disclosure. The IVOC 600 may comprise a determination module 620, a resource authority determination module 630, a resource occupation application module 640, and a safe path determination module 650.

The route search determination module 610 is for determining a route search extension distance of a train based on current location and speed of the train, wherein the current route search extension distance is the farthest distance in front of the train that is currently expected to be safe for operation based on current speed of the train.

The route resource determination module 620 is for determining the currently required link and route resource contained thereof according to current location of the train and the current route search extension distance.

The resource authority determination module 630 is for determining the target authority of the route resource, the target authority is either exclusive lock authority or shared lock authority.

The resource occupation application module 640 is for sending a route resource occupation request according to the target authority to an OC, and receiving a resource application result for the route resource occupation request returned by the OC.

The safe path determination module 650 is for determining the current safe path for the train based on the route search extension distance and the resource application result.

In an embodiment of the disclosure, it is preferable for the route search determination module 610 to determine the current route search extension distance of the train based on the current speed of the train, comprising:

$$L_{route\ search}=\max\{L_{dynamic}, L_{min}\}$$

wherein $L_{route}$ search represents the current route search extension distance; $L_{dynamic}$ represents the dynamic extension distance of the route search determined according to the current speed of the train, and $L_{dynamic}$ is proportional to the current speed of the train; and $L_{min}$ represents the default minimum extension distance. That is, the current route search extension distance is the larger value of the dynamic extension distance and the minimum extension distance.

In an embodiment of the present disclosure, $L_{dynamic}$ may be calculated as follows:

$$L_{dynamic}=K_1\times V_{current}^2+K_2\times V_{current}$$

wherein $V_{current}$ is the current speed of the train, $K_1$ is a first preset coefficient, $K_2$ is the second preset coefficient.

In an embodiment of the present disclosure, $K_1$ may be inversely proportional to the maximum braking rate of the train.

In an embodiment of the present disclosure, $K_2$ may be determined according to the following items: the time needed for the train to switch from the current state desired state according to the preset route resource, the preset time for interacting with the OC when requesting route resource from the OC, and the preset time for the OC to processing train route resource request.

In an embodiment of the disclosure, $$K_1 = \frac{1}{2 \times a_{barke}},$$

where $a_{brake}$ represents the maximum braking rate of the train.

In an embodiment of the disclosure, $K_2 = t_{resources\ drive} + t_{information\ interaction} + t_{information\ processing}$.

Wherein the $t_{resource}$ drive the time at which the route resource is switched from the current state to the desired state of the train (i.e., the estimated time for resource-drive, e.g., the time required for a turnout to switch to desired location for the train), and $t_{information\ interaction}$ represents the time for the train to interact with the OC when applying route resources from the OC, $t_{information\ processing}$ represents the time that the OC processes the route resource occupation request of the train.

In an embodiment of the present disclosure, the IVOC 600 also comprises an operation schedule determination module. The operation schedule determination module is for obtaining an operation schedule of a train; determining an entire line link sequence and route resources requested by the entire line based on the operation schedule, wherein the route resources requested by the entire line comprises route resources contained in the currently required link sequence.

In an embodiment of the present disclosure, the operation schedule of the train comprises the man-machine interface (MMI) arbitrary parking area operation schedule, wherein the MMI arbitrary parking area operation schedule is the operation schedule of the running path determined by the train itself based on the arbitrary position of the driver input obtained by the MMI module.

In an embodiment of the present disclosure, the route resource comprises turnouts. The resource authority determination module 630 is for determining target authority of a turnout based on desired state and current state of the turnout. Turnout states include positioning and inversion.

In an embodiment of the present disclosure, the resource authority determination module 630 is configured for the following: in case that the desired state of the turnout and the current state of the turnout are different, determining the target authority of the turnout as exclusive lock authority; in case that the desired state of the turnout is the same as the current state of the turnout and the train running mode is forward, determining the target authority of the turnout as shared lock authority; and in case that the desired state of the turnout is the same as the current state of the turnout and the train running mode is reentrant, determining the target authority of the turnout as exclusive lock authority.

In an embodiment of the present disclosure, if the desired state of the turnout is different from the current state, the route resource occupation request sent by the IVOC to the OC also comprises the corresponding turnout, wherein the switching instruction is used to switch the turnout from the current state to the desired state under control of the OC when the exclusive lock authority application of the corresponding turnout is successful.

In an embodiment of the present disclosure, the resource authority determination module 630 is further for sending an authority conversion request for the corresponding turnout to the OC after the corresponding turnout controlled by the OC is switched from the current state of the turnout to the desired state of the turnout, and the authority conversion request is used to request that the target authority of the corresponding turnout is switched from the exclusive lock authority to the shared lock authority.

In an embodiment of the present disclosure, the IVOC 600 may also include a mobile authorization calculation module. The mobile authorization calculation module is for, after the train has passed the route resources in the current MA, sending the resource release instruction of the available route resources to the OC so that the OC releases the target authority of the corresponding route resource requested by the train according to the resource release instruction, wherein the route resource release instruction comprises the route resources to be released and the target authority of the route resources to be released.

In an embodiment of the present disclosure, The mobile authorization calculation module is further for receiving the information that the target authority for route resource in the current safe path is cancelled sent by the OC; re-determining the current safe path, wherein the end of the re-determined current safe path does not exceed the proximal end of the corresponding route resource; re-calculating the current MA for the train based on the re-determined safe path; and controlling operation of the train based on the re-calculated current MA.

Figure 7:
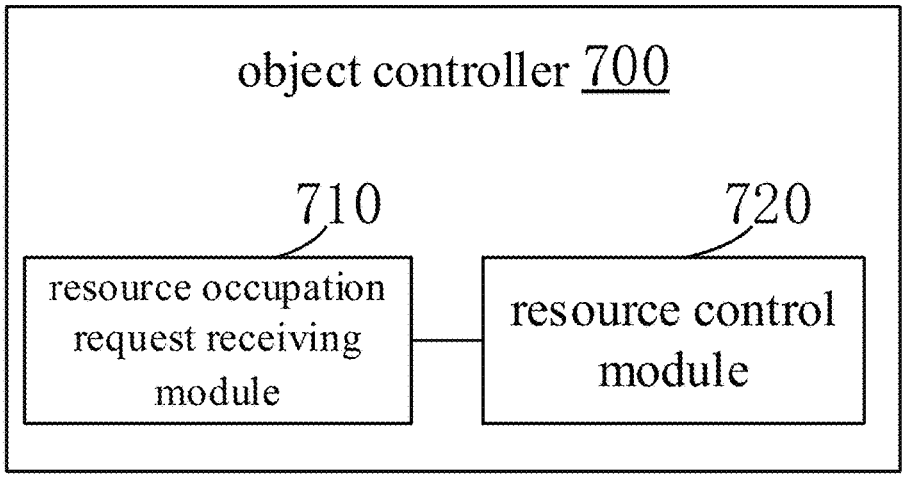
FIG. 7 is a schematic structural view of an object controller according to an embodiment of the present disclosure.

Corresponding to the route resource controlling method as shown in FIG. 5, an object controller (OC) 700 is further provided in an embodiment of the present disclosure. The OC 700 may comprise a resource occupation request receiving module 710 and a resource control module 720, as shown in FIG. 7.

The resource occupation request receiving module 710 is for receiving a route resource occupation request sent by the ITS system or IVOC, wherein the route resource occupation request comprises the requested route resource and the target resource thereof, wherein the target authority is exclusive lock authority or shared lock authority.

The resource control module 720 is for determining resource application result of the route resource occupation request based on the route resource occupation request and current state of the requested resource; and sending the resource application result to the ITS system or IVOC. The IVOC may determine the current safe path of the train based on the current route search extension distance and resource application result of the train; or the ITS system may determine the current safe path for the corresponding train based on the current route search extension distance and resource application result of the train that would be under control of the ITS system.

In an embodiment of the present disclosure, the resource control module 720 is further for receiving a route resource release instruction issued by the IVOC or ITS system, the route resource release instruction comprises the route resource to be released and the target authority thereof; and releasing the target authority for the corresponding route resource according to the route resource release instruction.

The route resource controlling method provided in an embodiment of the present disclosure, the vehicle controller and the object controller, consider the ground equipment required for operation as the route resource required for operation. The vehicle controller or the ITS system of the train realizes flexible resource management by applying resource for the OC. Compared with CI and ZC in traditional CBTC systems, the architecture of the OC is simpler and because all lines have the same resource type, there is no need to modify the configuration according to the line conditions, which is universal and better meets practical conditions.

The present disclosure may be embodied in other specific forms without departing from the spirit and essential characteristics thereof. Accordingly, the present embodiments are to be considered in all respects as illustrative and not restrictive, the scope of the present disclosure being defined by the appended claims rather than by the foregoing description. Further, all changes falling within the meaning and equivalents of the claims are considered to be within the scope of the present disclosure.

What is claimed is:

1. A route resource controlling method in an intelligent vehicle on-board controller (IVOC) on a train, the controlling method comprises:

determining a route search extension distance of the train based on current location and speed of the train, wherein the current route search extension distance is the farthest distance in front of the train that is currently expected to be safe for operation based on current speed of the train;

determining a currently required link sequence and route resource contained thereof according to current location of the train and the current route search extension distance, wherein the currently required link sequence comprises all path segments in the determined route search extension distance;

determining a target authority of the route resource, wherein the target authority is either exclusive lock authority or shared lock authority;

sending a route resource occupation request according to the target authority to an object controller (OC), and receiving a resource application result for the route resource occupation request returned by the OC; and determining the current safe path for the train based on the route search extension distance and the resource application result, wherein determining the current route search extension distance of the train based on the current speed of the train comprises:

$$L_{route\ search}=\max\{L_{dynamic}, L_{min}\}$$

wherein $L_{route\ search}$ represents the current route search extension distance; $L_{dynamic}$ represents the dynamic extension distance of the route search determined according to the current speed of the train, and $L_{dynamic}$ is proportional to the current speed of the train; and $L_{min}$ represents the default minimum extension distance.

2. The controlling method according to claim 1, wherein the method further comprises:

obtaining an operation schedule of a train; determining an entire line link sequence and route resources requested by the entire line based on the operation schedule, wherein the route resources requested by the entire line comprises route resources contained in the currently required link sequence.

3. The controlling method according to claim 2, wherein the operation schedule of the train comprises the man-machine interface (MMI) arbitrary parking area operation schedule, wherein the MMI arbitrary parking area operation schedule is the operation schedule of the running path determined by the train itself based on the arbitrary position of the driver input obtained by the MMI module.

4. The controlling method according to claim 1, wherein the route resource comprises turnouts; and the target authority of the turnout is determined based on desired state and current state of the turnout.

5. The controlling method according to claim 4, wherein the target authority of the turnout are determined based on the desired state of the turnout and the current state of the turnout, including:

in case that the desired state of the turnout and the current state of the turnout are different, determining the target authority of the turnout as exclusive lock authority;

in case that the desired state of the turnout is the same as the current state of the turnout and the train running mode is forward, determining the target authority of the turnout as shared lock authority; and in case that the desired state of the turnout is the same as the current state of the turnout and the train running mode is reentrant, determining the target authority of the turnout as exclusive lock authority.

6. The controlling method according to claim 5, wherein if the desired state of the turnout is different from the current state, the route resource occupation request sent by the IVOC to the OC also comprises the corresponding turnout, wherein the switching instruction is used to switch the turnout from the current state to the desired state under control of the OC when the exclusive lock authority application of the corresponding turnout is successful.

7. The controlling method according to claim 6, wherein after switching the turnout from the current state to the desired state, the controlling method further comprises:

sending an authority conversion request for the corresponding turnout to the OC after the corresponding turnout controlled by the OC is switched from the current state of the turnout to the desired state of the turnout.

8. An intelligent vehicle on-board controller (IVOC) on a train, the IVOC comprises:

a route search determination module, for determining a route search extension distance of the train based on current location and speed of the train, wherein the current route search extension distance is the farthest distance in front of the train that is currently expected to be safe for operation based on current speed of the train;

a route resource determination module, for determining the currently required link sequence and route resource contained thereof according to current location of the train and the current route search extension distance, wherein the currently required link sequence comprises all path segments in the determined route search extension distance;

a resource authority determination module, for determining a target authority of the route resource, wherein the target authority is either exclusive lock authority or shared lock authority; and a resource occupation application module, for sending a route resource occupation request according to the target authority to an OC, and receiving a resource application result for the route resource occupation request returned by the OC, wherein the current route search extension distance of the train is determined based on the current speed of the train:

$$L_{route\ search}=\max\{L_{dynamic}, L_{min}\}$$

wherein $L_{route\ search}$ represents the current route search extension distance; $L_{dynamic}$ represents the dynamic extension distance of the route search determined according to the current speed of the train, and $L_{dynamic}$ is proportional to the current speed of the train; and $L_{min}$ represents the default minimum extension distance.

9. The controlling method according to claim 1, wherein the $L_{dynamic}$ is calculated as follows:

$$L_{dynamic}=K_1\times V_{current}^2+K_2\times V_{current}$$

wherein $V_{current}$ is the current speed of the train, $K_1$ is a first preset coefficient, $K_2$ is the second preset coefficient, wherein $K_1$ and $K_2$ are positive numbers.

10. The intelligent vehicle on-board controller (IVOC) according to claim 8, further comprises an operation schedule determination module, wherein the operation schedule determination module is configured to obtain an operation schedule of a train; and determine an entire line link sequence and route resources requested by the entire line based on the operation schedule, wherein the route resources requested by the entire line comprises route resources contained in the currently required link sequence.

11. The intelligent vehicle on-board controller (IVOC) according to claim 10, wherein the operation schedule of the train comprises the man-machine interface (MMI) arbitrary parking area operation schedule, wherein the MMI arbitrary parking area operation schedule is the operation schedule of the running path determined by the train itself based on the arbitrary position of the driver input obtained by the MMI module.

12. The intelligent vehicle on-board controller (IVOC) according to claim 8, wherein the route resource comprises turnouts; and the target authority of the turnout is determined based on desired state and current state of the turnout.

13. The intelligent vehicle on-board controller (IVOC) according to claim 12, wherein the resource authority determination module is configured to:

determine the target authority of the turnout as exclusive lock authority in case that the desired state of the turnout and the current state of the turnout are different, determine the target authority of the turnout as shared lock authority in case that the desired state of the turnout is the same as the current state of the turnout and the train running mode is forward, and determine the target authority of the turnout as exclusive lock authority in case that the desired state of the turnout is the same as the current state of the turnout and the train running mode is reentrant.

14. The intelligent vehicle on-board controller (IVOC) according to claim 13, wherein if the desired state of the turnout is different from the current state, the route resource occupation request sent by the IVOC to the OC also comprises the corresponding turnout, wherein the switching instruction is used to switch the turnout from the current state to the desired state under control of the OC when the exclusive lock authority application of the corresponding turnout is successful.

15. The intelligent vehicle on-board controller (IVOC) according to claim 14, wherein the resource authority determination module is configured to:

send an authority conversion request for the corresponding turnout to the OC after the corresponding turnout controlled by the OC is switched from the current state of the turnout to the desired state of the turnout.

16. The intelligent vehicle on-board controller (IVOC) according to claim 8, wherein the $L_{dynamic}$ is calculated as follows:

$$L_{dynamic}=K_1\times V_{current}^2+K_2\times V_{current}$$

wherein $V_{current}$ is the current speed of the train, $K_1$ is a first preset coefficient, $K_2$ is the second preset coefficient, wherein $K_1$ and $K_2$ are positive numbers.

* * * * *